US006286626B1

(12) United States Patent
Evans

(10) Patent No.: US 6,286,626 B1
(45) Date of Patent: Sep. 11, 2001

(54) AUTOMATED OIL CHANGING SYSTEM

(75) Inventor: Larry D Evans, 1030 C & E Dr., Tignall, GA (US) 30668

(73) Assignees: Donna Bolton, Augusta, SC (US); Larry D Evans, Tignall, GA (US)

( * ) Notice: Subject to any disclaimer, the term of this patent is extended or adjusted under 35 U.S.C. 154(b) by 0 days.

(21) Appl. No.: 09/372,542

(22) Filed: Aug. 11, 1999

Related U.S. Application Data

(60) Provisional application No. 60/096,147, filed on Aug. 11, 1998.

(51) Int. Cl.[7] ..... F16C 3/14; F16N 33/00

(52) U.S. Cl. ..... 184/1.5; 141/98

(58) Field of Search ..... 184/1.5; 141/98, 141/65, 198

(56) References Cited

U.S. PATENT DOCUMENTS

| | | | |
|---|---|---|---|
| 3,447,636 | 6/1969 | Bonfilio . | |
| 4,674,456 | 6/1987 | Merritt . | |
| 4,884,660 | 12/1989 | Bedi . | |
| 4,909,205 | 3/1990 | Bewley, III . | |
| 4,951,784 | 8/1990 | Bedi . | |
| 4,976,233 | 12/1990 | Bedi et al. . | |
| 5,044,334 | 9/1991 | Bedi . | |
| 5,056,621 | 10/1991 | Trevino . | |
| 5,062,398 | 11/1991 | Bedi et al. . | |
| 5,074,380 | 12/1991 | Bedi et al. . | |
| 5,154,775 | 10/1992 | Bedi . | |
| 5,203,429 | 4/1993 | Zager . | |
| 5,209,198 | 5/1993 | Bedi . | |
| 5,263,445 | 11/1993 | Bedi et al. . | |
| 5,273,085 | 12/1993 | Edwards et al. . | |
| 5,327,862 | 7/1994 | Bedi . | |
| 5,372,219 | 12/1994 | Peralta . | |
| 5,487,447 | 1/1996 | Martinez Velazquez . | |
| 5,588,502 | 12/1996 | Bedi . | |
| 5,635,625 | 6/1997 | Tsunoda . | |
| 5,669,464 | 9/1997 | Earleson . | |
| 6,035,903 * | 3/2000 | Few et al. | 184/1.5 |

* cited by examiner

*Primary Examiner*—David Fenstermacher
(74) *Attorney, Agent, or Firm*—Michael A Mann; Nexsen Pruet Jacobs & Pollard LLC

(57) ABSTRACT

An automated system for changing the motor oil in an engine. The system includes a drain plug having a plurality of channels coupled with tubing that extends to a reversible pump. Tubing extends from the pump to both a used oil container and a new oil container. Check valves positioned at the entrance of each container restrict flow so the oil can flow only to the used oil container and only flows from the new oil container. Preferably, both containers are located in the trunk of the vehicle for easy access. In use, the pump is engaged to draw the used motor oil from the engine into the used oil container. Next, the pump is reversed to draw fresh oil from the new oil container into the engine.

15 Claims, 3 Drawing Sheets

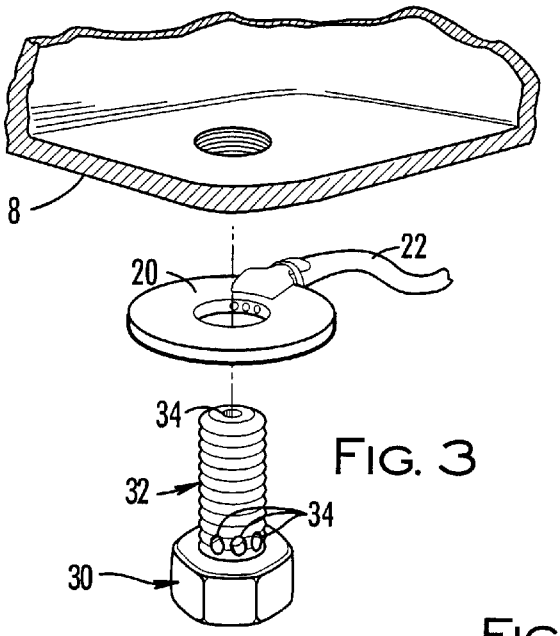
FIG. 3
FIG. 4A
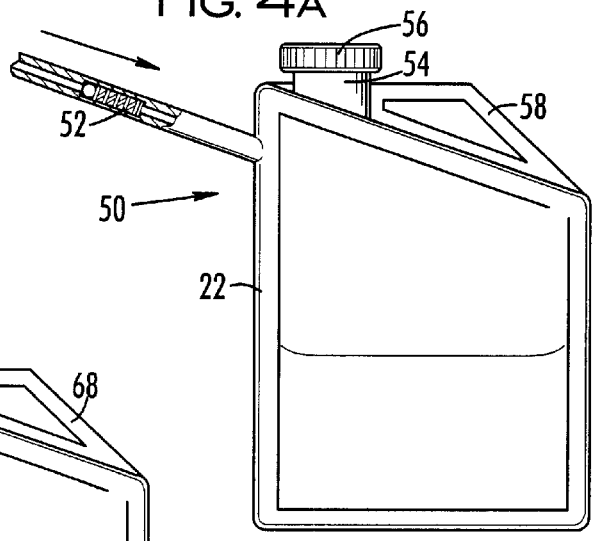
FIG. 4B
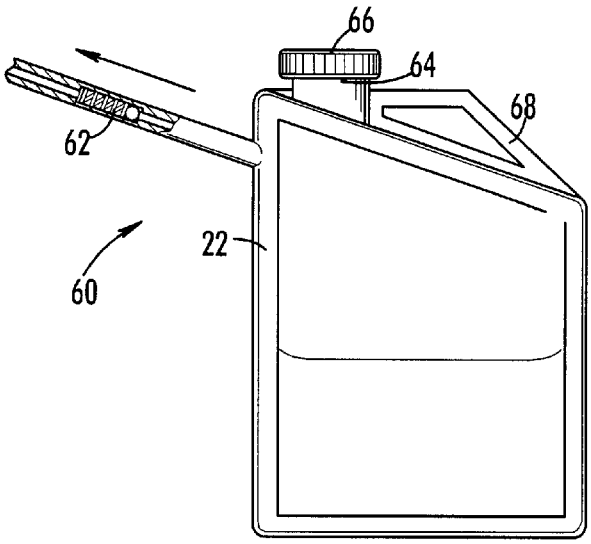

AUTOMATED OIL CHANGING SYSTEM

PRIORTY CLAIM

This application claims the benefit of U.S. Provisional Application No. 60/096,147, filed on Aug. 11, 1998, which is hereby incorporated by reference.

BACKGROUND OF THE INVENTION

1. Field of the Invention

The present invention relates to changing the motor in a vehicle. In particular, the present invention relates to automated systems for changing motor oil in an engine.

2. Discussion of Background

Even though society has become increasingly efficient, individuals must still waste time for routine maintenance on their vehicles. Many are stranded at service centers while waiting for the maintenance to be finished. Others are inconvenienced by resorting to a courtesy van or finding another source of transportation to work while the vehicle is being serviced. These individuals not only waste time driving to the service center, but are also confined to the dealer's service schedule. For those managing the maintenance of a rental or service fleet, this inconvenience can also be a logistical problem.

Although many "quick lubes" business have been established to perform quick oil changes, these businesses do not make house calls; in other words, individuals employing these services must still travel to the "quick lube" location. Several patents, such as U.S. Pat. No. 5,372,219 to Peralta and U.S. Pat. No. 4,884,660 to Bedi, attempt to provide a method to speed up the oil change process. However, the adoption of these devices has been dismal due to their complexity. Therefore, there is a need for an automated oil changing device that is easy to use and provide convenient access to fluid storage.

SUMMARY OF THE INVENTION

According to its major aspects and broadly stated, the present invention is an automated system for changing the motor oil in an engine. The system comprises a drain plug having a plurality of channels coupled with tubing that extends to a reversible pump. Tubing extends from the pump to both a used oil container and a new oil container. Check valves positioned at the entrance of each container restrict flow so the oil can flow only to the used oil container and only flows from the new oil container. Preferably, both containers are located in the trunk of the vehicle for easy access. In use, the pump is engaged to draw the used motor oil from the engine into the used oil container. Next, the pump is reversed to draw fresh oil from the new oil container into the engine.

A major advantage of the present invention is the reduction in time to change the motor oil in a vehicle. The system not only quickly changes the oil, but also eliminates the need to travel to a service station. The feature of having the containers located in the trunk further aids in saving time. As a result of the savings in time, the overall vehicle maintenance cost is reduced. Particularly for service vehicles, such as rental cars, overall maintenance costs will be drastically reduced.

Another important advantage of the present invention is the elimination of contamination into the environment. Oil will not spill onto the ground or dirty clothing during the process. Even if the user missed the opening on the new oil container, the excess oil will not fall onto the engine; as a result, the engine will not smoke from the burnt oil. Moreover, the containers can be reused for multiple oil changes. Also, since the fresh oil is held within new oil container before entering engine, no contaminants could enter the engine.

Another important advantage of the present invention is the increased safety. The car will not need to be lifted up with a jack or placed upon a lift to perform the oil change. Consequently, the likelihood that a car will fall from the jack or lift is eliminated.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 3 is a detailed view of the plug and ring, according to a preferred embodiment of the present invention;

FIG. 4A is a detailed side view of the used oil container, according to a preferred embodiment of the present invention;

FIG. 4B is a detailed side view of the new oil container, according to a preferred embodiment of the present invention.

DETAILED DESCRIPTION OF A PREFERRED EMBODIMENT

Figure 1:
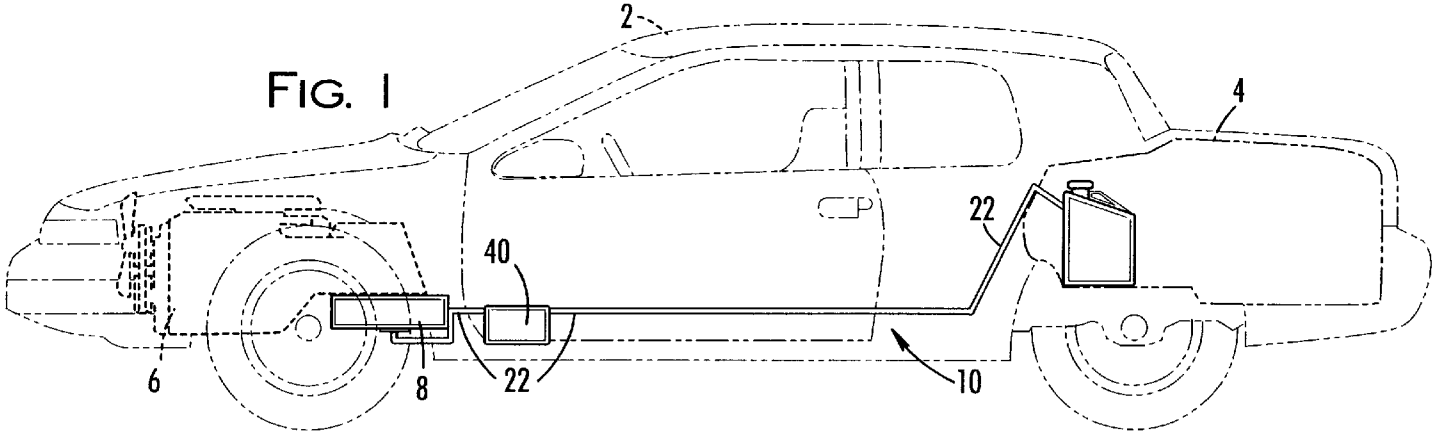
FIG. 1 is a schematic view of a vehicle containing the oil changing system, according to a preferred embodiment of the present invention.

Referring now to the figures, the present invention is an automated system for changing the motor oil in an engine. The system, generally referred to by reference number 10, comprises a drain plug 30 coupled with tubing 22 which extends to a reversible pump 40. A used oil container 50 and a new oil container 60 are in fluid communication with pump 40 using tubing 22. It will be clear to those skilled in the art that system could be used for replacing any type of fluid in an engine.

Figure 2A:
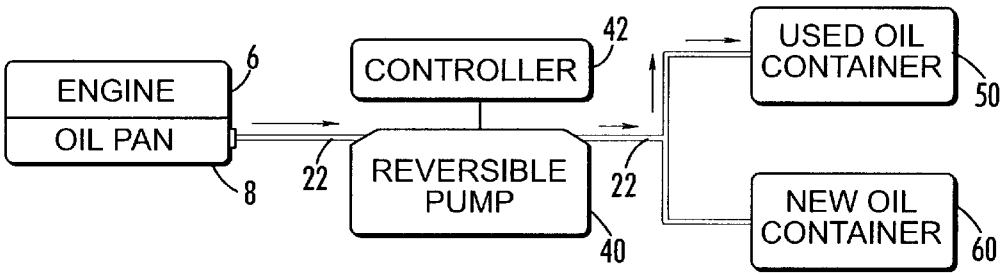
FIG. 2A is a schematic view the oil changing system with the used oil being drawn from the engine into the used oil container, according to a preferred embodiment of the present invention.
Figure 2B:
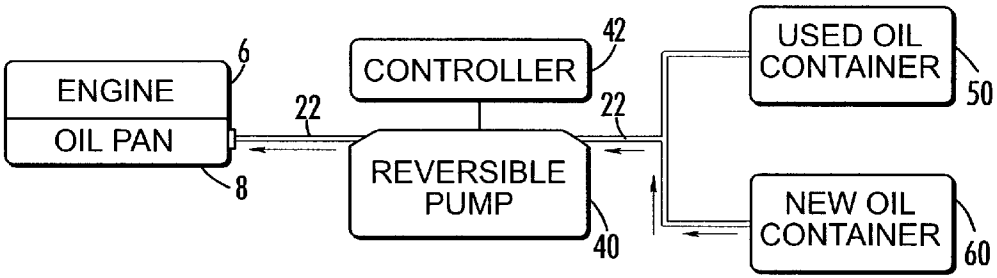
FIG. 2B is a schematic view the oil changing system with the fresh oil being drawn from the new oil container into the engine, according to a preferred embodiment of the present invention.

Drain plug 30 with coupling 20 and tubing 22 allow fluid communication between oil pan 8 and both used oil container 50 and new oil container 60. Drain plug 30 has at least one channel 32 positioned to allow fluid communication between plug 30 and coupling 20. Although only one channel is needed, preferably drain plug 30 has a plurality of channels to allow fluid communication with coupling 20. As illustrated in FIG. 3, coupling 20 is mounted to plug 30 so that coupling 20 collects oil flowing from channels 32 of plug 30 to provide fluid communication with tubing 22. Coupling 20 may be made from rubber, aluminum or hard plastic, but is preferably made from steel. Preferably, coupling 20 is permanently connected to oil pan 8 by silver solder or brazed. Tubing 22 extending from coupling 20 preferably has a flexible portion which extends to a rigid portion. Tubing 22 preferably is mounted to vehicle chassis or body. As illustrated in FIGS. 2A–2B, tubing is positioned between coupling 20 and pump 40; also, tubing is positioned between pump 40 and containers 50 and 60.

Pump 40 is a reversible pump so that oil can either be drawn from oil pan 8 or from containers 50 and 60. Preferably, pump 40 is positioned in a lower elevation with respect to tubing 22. Controller 42 has a drain state that engages pump 40 to draw oil from oil pan 8 to used oil container 50 and a fill state that engages pump 40 to draw oil from new oil container 60 into oil pan 8. Although many electrical and mechanical means exist in the art to control operation of pump 40, preferably controller 42 is a double throw switch, with a position for the fill state, drain state and off.

Figure 5:
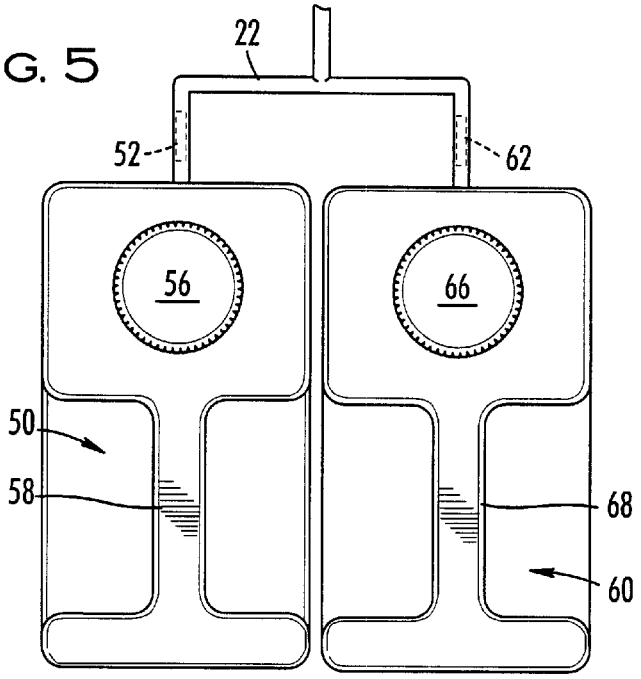
FIG. 5 is a top view of the containers, according to a preferred embodiment of the present invention; and, FIG. 6 is a side view of the containers with holder, according to a preferred ambodiment of the present invention.
Figure 6:
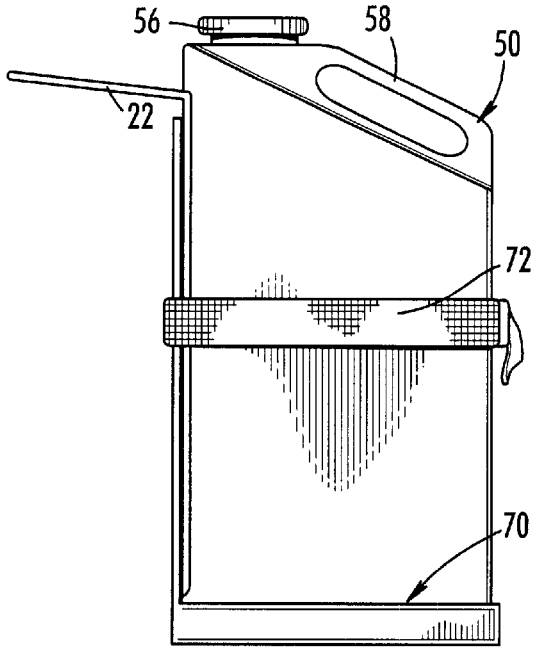

As illustrated in FIG. 5, tubing 22 extends from pump 40 into containers 50 and and 60; preferably, elevation of tubing 22 is angled down into containers 50 and 60. A first check valve 52 is positioned near the used oil container 50 to prevent the flow of oil from used oil container 50 into tubing 22 as illustrated in FIG. 4A. Instead, first check valve 52 only allows flow of oil into used oil container. A second check valve 62 positioned near new oil container 60 is configured in an opposite manner to restrict the flow of oil from new oil container 50 into tubing 22 as illustrated in FIG. 4B. Any other method known the art to restrict the flow of a fluid to a particular direction could be easily substituted for check valves 52 and 62.

Containers 50 and 60 may be formed in any shape capable of holding oil. Each container 50 and 60 has an externally threaded opening 54 and 64 and internally threaded lids 56 and 66 to remove oil and fill with oil, respectively. Although containers 50 and 60 can be mounted anywhere in the vehicle, such as the hood, glove box or any other convenient location, preferably containers 50 and 60 are mounted in the trunk 4 of vehicle 2. Containers 50 and 60 may be secured in trunk 4, by adhesive, bolted, or any other method known in the art, but preferably are secured using holder 70 with strap 72. Although each container 50 and 60 could have separate holders 70 or be mounted in separate locations, holder 70 is preferably dimensioned to hold both containers 50 and 60. Strap 72 preferably has hook and loop fasteners to detachably secure containers 50 and 60.

In use, initially remove used oil from oil pan 8 by setting controller in drain state to engage pump 40. Pump 40 drains oil through tubing 22 into used oil container 50. Next, with fresh oil in new oil container 60, set controller 42 to fill state to engage pump 40. Pump 40 draws fresh oil from new oil container 60 into oil pan 8.

It will be apparent to those skilled in the art that many changes and substitutions can be made to the preferred embodiment herein described without departing the spirit and scope of the present invention.

What is claimed is:

1. A system for changing oil in a vehicle having an oil pan with a drain opening, said system comprising:

a used oil container;

a new oil container, wherein said new oil container and said used oil container are positioned within a trunk of a vehicle;

tubing means for coupling with both said used oil container and said new oil container;

a reversible pump in fluid communication with said tubing means, said pump having drain state and a fill state, said pump draining said a container when in said drain state and filling said container when in said fill state; and controller means in operative connection with said pump, said controller means controlling said pump so that oil flows from said oil pan to said used oil container, said controller means having a fill state that engages said pump so that oil flows from said new oil container to said oil pan.

2. The system as recited in claim 1, further comprising a drain plug capable of coupling with the drain opening, said drain plug having a plurality of holes therethrough, said tubing means being in fluid communication with the oil pan through said plurality of holes in said drain plug.

3. The system as recited in claim 2, wherein said drain plug is affixed to said drain opening.

4. The system as recited in claim 1, further comprising a second check valve carried in said tubing means, said second check valve restricting oil from flowing from said old oil container.

5. The system as recited in claim 1, wherein said tubing means further comprises a tee-connection having a first portion in fluid communication with said new oil container and a second portion in fluid communication with said old oil container, wherein said first portion carries a first check valve therein which restricts oil from flowing into said new oil container and wherein said second portion carries a second check valve therein which restricts oil from flowing from said old oil container.

6. The system as recited in claim 1, further comprising a first check valve carried in said tubing means, said first check valve restricting oil from flowing into said new oil container.

7. A system for changing oil in a vehicle having an oil pan with a drain opening, said system comprising:

a used oil container;

a new oil container, wherein said new oil container and said used oil container are positioned within a trunk of a vehicle;

a drain plug capable of coupling with the drain opening, said drain plug having a plurality of holes therethrough, tubing means being in fluid communication with the oil pan through said plurality of holes in said bolt, said tubing means being in fluid communication with both said used oil container and said new oil container;

a reversible pump in fluid communication with said tubing means; and controller means in operative connection with said pump, said controller means having a drain state that engages said pump so that oil flows from said oil pan to said used oil container, said controller means having a fill state that engages said pump so that oil flows from said new oil container to said oil pan.

8. The system as recited in claim 7, wherein said tubing means further comprises a tee-connection having a first portion in fluid communication with said new oil container and a second portion in fluid communication with said old oil container, wherein said first portion carries a first check valve therein which restricts oil from flowing into said new oil container and wherein said second portion carries a second check valve therein which restricts oil from flowing from said old oil container.

9. The system as recited in claim 7, further comprising a first check valve carried in said tubing means, said first check valve restricting oil from flowing into said new oil container.

10. The system as recited in claim 7, further comprising a second check valve carried in said tubing means, said second check valve restricting oil from flowing from said old oil container.

11. A system for changing oil in a vehicle having an oil pan with a drain opening said system comprising:

a used oil container;

a new oil container, wherein said new oil container and said used oil container are positioned within a trunk of a vehicle;

tubing means coupled with said drain opening for providing fluid communication with both said used oil container and said new oil container;

fluid restricting means for restricting fluid communications in said tubing means between said used oil container and said new oil container;

a reversible pump in fluid communication with said tubing means; and controller means in operative connection with said pump, said controller means having a drain state that engages said pump so that oil flows from said oil pan to said used oil container, said controller means having a fill state that engages said pump so that oil flows from said new oil container to said oil pan.

12. The system as recited in claim 11, further comprising a drain plug capable of coupling with the drain opening, said drain plug having a plurality of holes therein, said tubing means being in fluid communication with the oil pan through said plurality of holes in said bolt.

13. The system as recited in claim 11, wherein said fluid restricting means comprises a first check valve carried in said tubing means, said first check valve restricting oil from flowing into said new oil container.

14. The system as recited in claim 11, wherein said fluid restricting means comprises a second check valve carried in said tubing means, said second check valve restricting oil from flowing from said old oil container.

15. The system as recited in claim 11, wherein said tubing means further comprises a tee-connection having a first portion in fluid communication with said new oil container and a second portion in fluid communication with said old oil container, wherein said first portion carries a first check valve therein which restricts oil from flowing into said new oil container and wherein said second portion carries a second check valve therein which restricts oil from flowing from said old oil container.

* * * * *